United States Patent [19]

Wener et al.

[11] 4,049,224

[45] Sept. 20, 1977

[54] CHAIN-LINK FENCING PACKAGE AND METHOD OF MAKING SAME

[75] Inventors: Kurt Wener; Günter Stock; Klaus Herrig; Heinz Wagner, all of St. Ingbert, Germany

[73] Assignee: ARBED, Acieries Reunies de Burbach-Eich-Dudelange, Luxembourg, Luxembourg

[21] Appl. No.: 608,340

[22] Filed: Aug. 27, 1975

Related U.S. Application Data

[63] Continuation-in-part of Ser. No. 471,907, May 21, 1974, abandoned.

[30] Foreign Application Priority Data

May 26, 1973 Germany ..... 2327005

[51] Int. Cl.[2] ..... B21F 27/04

[52] U.S. Cl. ..... 245/6; 140/3 R; 140/107

[58] Field of Search ..... 140/3, 92.3, 92.4, 92.7, 140/107, 7, 9; 245/6, 7, 8; 72/137; 256/33, 45; 139/425

[56] References Cited

U.S. PATENT DOCUMENTS

| | | | |
|---|---|---|---|
| 197,681 | 11/1877 | Sturmberg | 256/45 |
| 398,428 | 2/1889 | Midgley | 139/425 |
| 461,695 | 10/1891 | White et al. | 140/92.7 |
| 502,087 | 7/1893 | Tourasse | 256/45 |
| 784,564 | 3/1905 | Horsley | 256/45 |
| 795,529 | 7/1905 | Mafera | 256/45 |
| 3,667,509 | 6/1972 | Rohrbacher | 140/3 |

FOREIGN PATENT DOCUMENTS

| | | | |
|---|---|---|---|
| 402,040 | 5/1966 | Switzerland | 256/45 |

*Primary Examiner*—Lowell A. Larson
*Attorney, Agent, or Firm*—Karl F. Ross

[57] ABSTRACT

Chain-link fencing consisting of a mesh of interlinked wire coils is flattened so as to have an overall thickness perpendicular to the plane of the mesh equal to between two and five times the diameter of the wire constituting the coils. Thereupon the flattened mesh is either rolled up into tight rolls, or is laid meander-fashion in a container. The mesh may be flattened by means of a platen press operating synchronously and immediately downstream of a fence-weaving machine that produces the mesh step-wise, or by a pair of rollers.

2 Claims, 7 Drawing Figures

CHAIN-LINK FENCING PACKAGE AND METHOD OF MAKING SAME

CROSS-REFERENCE TO RELATED APPLICATION

This application is a continuation-in-part of our copending patent application 471,907 filed May 21, 1974 now abandoned.

FIELD OF THE INVENTION

The present invention relates to chain-link fencing. More particularly this invention concerns a method of making a package of such fencing and the package so made.

BACKGROUND OF THE INVENTION

Chain-link fencing is formed of a multiplicity of like wire coils or spirals which are integrated so as to form a flexible and extremely durable mesh. The coils are interlinked with one another on so-called chain-link machines which weave with heavey-gauge vinyl-coated or galvanized wire, or with aluminum wire. The fence fabric so produced is of open construction and is generally rolled up into a large-diameter rolls for transport.

Such rolls of chain-link fencing are extremely bulky. The fencing fabric does not lend itself to being rolled up tightly. Thus the storage and transport of such rolls is expensive.

It has been suggested to overcome this considerable disadvantage by shifting the wire coils longitudinally relative to each other, that is by compressing the mesh formed by the coils in the plane of the mesh. This operation greatly increases the density of the fencing, but has the disadvantage that much of the structural stability of the fencing is lost so that the coils can come partially apart, thereby requiring the fencing to be painstakingly put together again would an accident occur. Furthermore when longitudinally compressed in this manner the ends of the coils frequently catch on each other and make it difficult to expand the mesh back to its original size.

OBJECTS OF THE INVENTION

It is therefore an object of the present invention to provide an improved method of and an apparatus for making chain-link fencing.

Another object of this invention is the provision of a method of and an apparatus for packaging chain-link fencing.

Yet another object is the provision of a very compact package of chain-link fencing.

SUMMARY OF THE INVENTION

These objects are attained according to the present invention in a system wherein the interlinked wire coils forming the mesh of the chain-link fencing are flattened immediately after weaving to reduce their overall thickness perpendicular to the mesh plane from a dimension equal to between five and eight times the diameter of the wire constituting the coils to a dimension equal to between two and five times this diameter. Thereafter the flattened mesh is compacted into tight packages.

In accordance with the present invention the individual spirals forming the fencing mesh are before flattening of oval projection taken longitudinally to the direction of the spiral. These spirals lay parallel to one another and diagonally transverse to the longitudinal direction of the fencing. Prior to flattening the coils each have a thickness taken perpendicular to the plane of the mesh which is between five and eight times the diameter of the wire constituting the coils. Thus the thickness of the mesh is reduced by between one-third and two-thirds, imparting to the coils a cross-sectional shape which is no longer oval but quite elongated. Depending on the pressure used to flatten the coils the wire sections lying between the bends or angles of the spiral can be slightly concave or convex within the predetermined dimensions.

Rolls made from flattened mesh as described above take up much less room than the prior art rolls. This greatly reduces cost of storing and/or transporting these rolls. A similar economy is realized when the mesh is loaded meander-fashion into cartons.

According to other featuresof this invention the flattening takes place immediately downstream from the chain-link fence-weaving machine. Either a pair of flattening rollers spaced apart by the requisite distance can be employed, or a platen press operating synchronously with the step-wise operation of the weaving machine.

In accordance with another feature of this invention the fencing is prepared for transport by being unrolled from a large-diameter roll, then flattened, and finally formed into compact packages as described above.

In accordance with yet another feature of this invention the flattened mesh is longitudinally compressed by displacing the downstream coils toward the upstream coils, thereby fitting them together and considerably increasing the density of the mesh.

BRIEF DESCRIPTION OF THE DRAWING

The above objects, features, and advantages will become more readily apparent from the following description, reference being made to the accompanying drawing in which.

SPECIFIC DESCRIPTION

Figure 1:
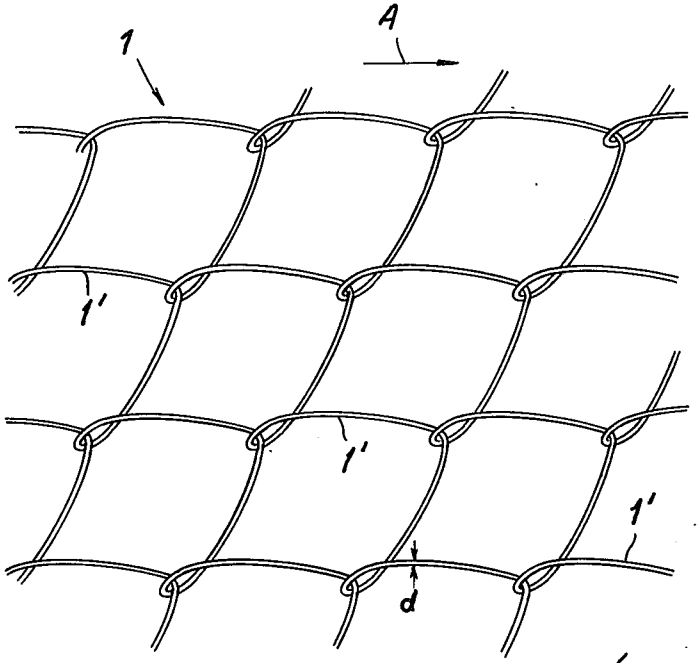
FIGS. 1 and 2 show the mesh in untreated and flattened conditions repsectively.
Figure 2:
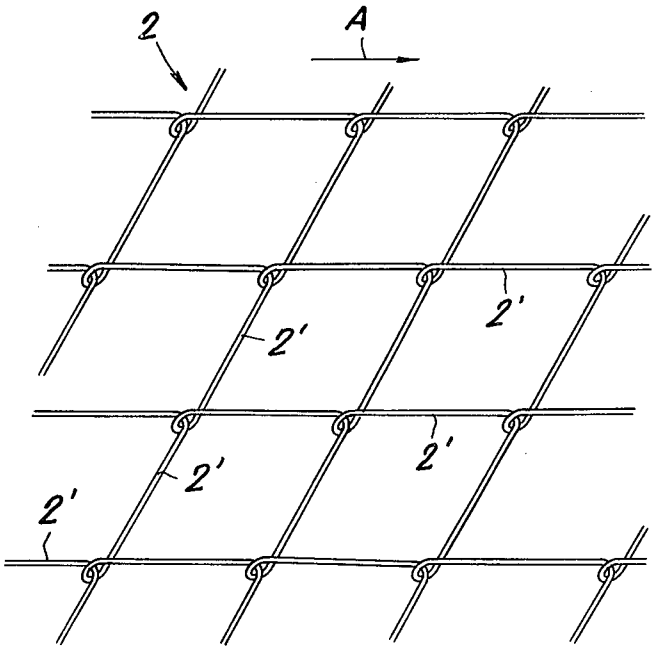
Figure 3:
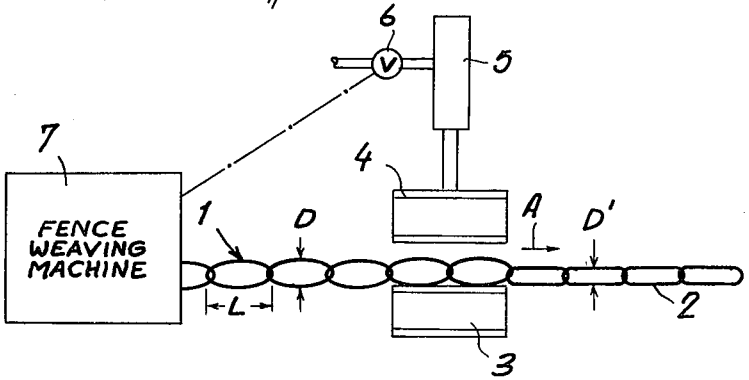
FIG. 3 shows a platen press arrangement for carrying out the method of the present invention.
Figure 7:
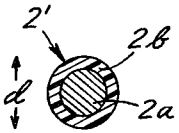
FIG. 7 is a cross-section through a wire according to this invention.

A mesh 1 is made by a conventional chain-link weaving machine 7 such as described in U.S. Pat. No. 3,512,760 and other patents cited therein. This fencing 1 is formed of a multiplicity of like coils 1' forming a mesh with rhombic openings, the coils 1' extending at an angle of approximately 45° to the longitudinal direction A of the mesh. As shown in FIG. 7 the wire **2*a* forming these coils 1' has a vinyl covering 2*b*** and has a diameter *d*. Seen from the end the coils or spirals 1' are of oval cross-section and have a dimension D corresponding to the thickness of the mesh 1. The coils 1' also have a length L.

This mesh 1 is fed step-wise between a lower fixed platen 3 and an upper platen 4 displaceable by a hydraulic ram 5 controlled synchronously by a valve 6 connected to the synchronously operating fence-weaving machine 7. This press 3, 4, reduces the mesh 1 to a mesh 2 formed of coils 2' and having a thickness D'. In use this compression of the fencing often relaxes somewhat leaving the overall thickness D' which is nontheless considerably smaller than the original thickness. The side sections of the coils 2' are virtually parallel to each other and lay one directly on top of the other at the cross-over points so that the fencing so flattened is as attractive and at the same time as strong as the unflattened fencing. Such compression has been found in no way to damage the vinyl coating. It is possible to weave synthetic-resin strips into each coil to make the fencing substantially solid, and to provide tensioning wires right at the manufacturing plant.

Figure 4:
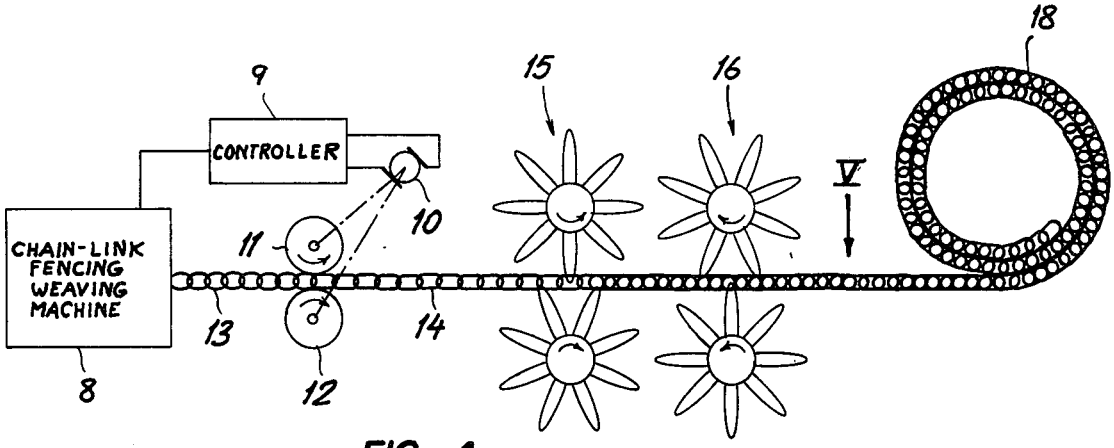
FIG. 4 shows a roller press arrangement for carrying out the present invention.
Figure 5:
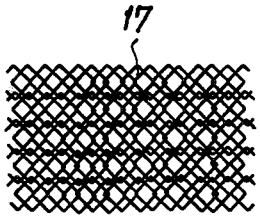
FIG. 5 is a view taken in the direction of arrow 5 of FIG. 4.

FIG. 4 shows a chain-link fencing weaving machine 8 having a controller 9 connected through a motor 10 to a pair of rolls 11 and 12 spaced apart by the distance 0' at their outer peripheries so as to compress mesh 13 into a flattened mesh 14. Downstream of the roller press 11, 12 are two pairs 15 and 16 of oppositely driven spoked elements which serve to longitudinally compress the mesh 14 into a mesh 17 shown in FIG. 5 which is then rolled up on to a roll 18. Longitudinal compression here means that the downstream coils constituting the mesh 14 are pushed back on their upstream coils so as to close the mesh holes of the fencing and greatly increase the density thereof.

Figure 6:
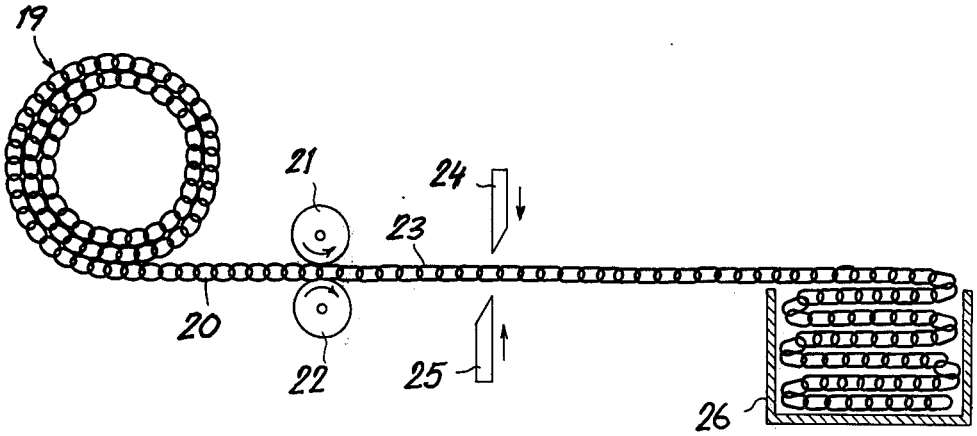
FIG. 6 shows another arrangement for preparing the mesh according to the present invention for transport or staorage.

FIG. 6 shows a large supply roll 19 as unflattened fencing mesh 20 which passes between a pair of rollers 21 and 22 so as to form a flattened mesh 23. A pair of blades 24 and 25 downstream of the roller press 21, 22 serve to cut off sections of the flattened mesh which is then loaded into cartons 26 in a meander-style array, that is back and forth in a heap.

Light-duty chain-link fencing made according to the present invention with wire of 1.8 mm diameter (d) and generally square holes 15 mm on a side (L) has a transverse thickness D of 9.0 mm after weaving and is flattened to have a transverse thickness D' of 4.0 mm. Medium duty wire of 2.8 mm diameter (*d*) with L equal to 50 mm had an original thickness of 19.6 mm and was flattened to a thickness D' of 10.0 mm. In heavy-duty fencing *d* equals 3.1 mm, L equals 100 mm, D equals 24 mm, and D' equals 16.0 mm. All of these fencings were packed in rolls of 25 meters and the diameters of these rolls were between smaller by almost exactly one-fourth the diameter of rolls of unflattened fencing. Since the volume of each role is proportional to the square of the radius of the role, sixteen roles of flattened fencing according to the invention can fit in the same space that would be occupied by nine roles of prior-art unflattened fencing.

We claim:

1. A method of making a package of chain-link fencing, said method comprising the steps of:

weaving round-section metal wire provided with a protective synthetic-resin covering into a mesh of interlinked wire coils having a transverse thickness equal to between five and eight times the overall diameter of the coated wire, flattening the coils of said mesh immediately following weaving thereof to reduce said transverse thickness to a dimension equal to between two and four times said diameter, and, rolling up the flattened-coil mesh.

2. A chain-link fencing package comprising a tightly wound roll of a mesh of metal interlinked coils formed of wire having a synthetic-resin covering and an overall outside diameter, said mesh having a maximum transverse thickness equal to between two and four times said overall diameter.

* * * * *